US009532667B2

(12) United States Patent
Ruddis

(10) Patent No.: US 9,532,667 B2
(45) Date of Patent: Jan. 3, 2017

(54) REUSABLE BAG CARRIER AND DISPENSER

(71) Applicant: Becky Ann Ruddis, Rowlett, TX (US)

(72) Inventor: Becky Ann Ruddis, Rowlett, TX (US)

( * ) Notice: Subject to any disclaimer, the term of this patent is extended or adjusted under 35 U.S.C. 154(b) by 0 days.

(21) Appl. No.: 14/605,938

(22) Filed: Jan. 26, 2015

(65) Prior Publication Data

US 2015/0208834 A1 Jul. 30, 2015

Related U.S. Application Data

(60) Provisional application No. 61/931,197, filed on Jan. 24, 2014.

(51) Int. Cl.
*A47F 13/08* (2006.01)
*A45F 5/10* (2006.01)

(52) U.S. Cl.
CPC ..... *A47F 13/085* (2013.01); *A45F 5/1026* (2013.01); *A45F 2005/1033* (2013.01)

(58) Field of Classification Search
CPC ..... A47F 9/042; A47F 13/085; A45F 5/1026; A45F 2005/1033
USPC ..... 211/85.15, 12; 248/95–101
See application file for complete search history.

(56) References Cited

U.S. PATENT DOCUMENTS 1,353,330 A * 9/1920 Erickson ..... B65B 67/12 248/101
4,428,610 A * 1/1984 Guffey ..... E01H 1/1206 294/1.3
4,738,478 A * 4/1988 Bean, Jr. ..... B65B 67/1233 248/101
5,217,271 A * 6/1993 Moe ..... B65B 67/1233 248/99
5,413,261 A * 5/1995 Wu ..... A45F 3/14 215/396
6,086,022 A * 7/2000 Dalton ..... B65F 1/1415 248/101
6,488,242 B1 * 12/2002 Barriere ..... B65B 67/1233 248/100
7,552,956 B1 * 6/2009 Holloway ..... B65F 1/00 294/152
8,267,358 B1 * 9/2012 Letson ..... B65B 67/1238 248/101
2004/0035899 A1 * 2/2004 Reynolds ..... A45F 3/14 224/585
2006/0038420 A1 * 2/2006 Sapp ..... B65B 67/1233 294/214
2007/0278807 A1 * 12/2007 Jenkins ..... A45F 5/1026 294/159

* cited by examiner

*Primary Examiner* — Korie H Chan

(57) ABSTRACT

A device for holding and dispensing reusable bags includes a structural base, a first arm-bracing wing, a second arm-bracing wing, an elastic restraint, and a bag storing hanger. When in use, a plurality of reusable bags is initially hooked onto a hook portion of the bag storing hanger. The elastic restraint secures the plurality of reusable bags with the structural base such that the plurality of reusable bags is stored on a racking portion of the bag storing hanger. The first arm-bracing wing and the second arm-bracing wing rest on a grocery bag holder when the device is used to dispense the plurality of reusable bags. A handle extending from the structural base allows the user to carry the device conveniently.

15 Claims, 19 Drawing Sheets

REUSABLE BAG CARRIER AND DISPENSER

The current application claims a priority to the U.S. Provisional Patent application Ser. No. 61/931,197 filed on Jan. 24, 2014. The current application is filed on Jan. 26, 2015 while Jan. 24, 2014 was on a weekend.

FIELD OF THE INVENTION

The present invention relates generally to a storage, transport, and dispensing apparatus for reusable shopping bags. More specifically, the present invention is a carrying apparatus for shopping bags, reusable bags specifically, that is compatible with existing counter standing grocery bag holders and also with proprietary bag dispensing arms.

BACKGROUND OF THE INVENTION

In recent years, public awareness about the detrimental effects that plastic bags can have upon the environment has been steadily increasing. As a result, the prevalence of reusable bags in the shopping industry is rising as reusable bags offer a more environmentally friendly alternative to the old plastic bags. Hundreds of thousands of sea animals die every year from the consumption of discarded plastic bags. The manufacturing process itself releases harmful toxins into the environment. Every year about five hundred billion to one trillion plastic bags are used and discarded worldwide; costing retailers billions of dollars and causing devastating and permanent environmental damage. The extent of the waste is so extreme that it has started a cottage industry in Africa, where plastic bags are used as raw material for weaving of goods. To combat this trend the consumer is being encouraged to shop with reusable grocery bags. Reusable shopping bags are an alternative means to plastic bags, often comprising fabric material such as canvas and synthetic fibers. Reusable grocery bags may require more energy to produce, but they are environmentally friendly and do not need to be discarded after each use.

With the modern consumer becoming more aware of their affect on the environment; an environmentally sensitive life style is becoming the new norm. Part of that norm is the use of reusable grocery bags. The present invention seeks to promote the use of reusable grocery bags by increasing the ease of use of said product comparable to existing plastic bags in local grocery stores. The present invention allows the user to comfortably and efficiently transport, store, and load their reusable grocery bags at the retail store or supermarket. Increasing the ease of use of reusable grocery bags makes the environmentally friendly product appealing and thus promoting an environmentally conscious society. The present invention creates a comfortable portable carrier for reusable grocery bags that is also compatible with the majority of grocery bagging racks used in today's supermarkets.

DETAIL DESCRIPTIONS OF THE INVENTION

Figure 1:
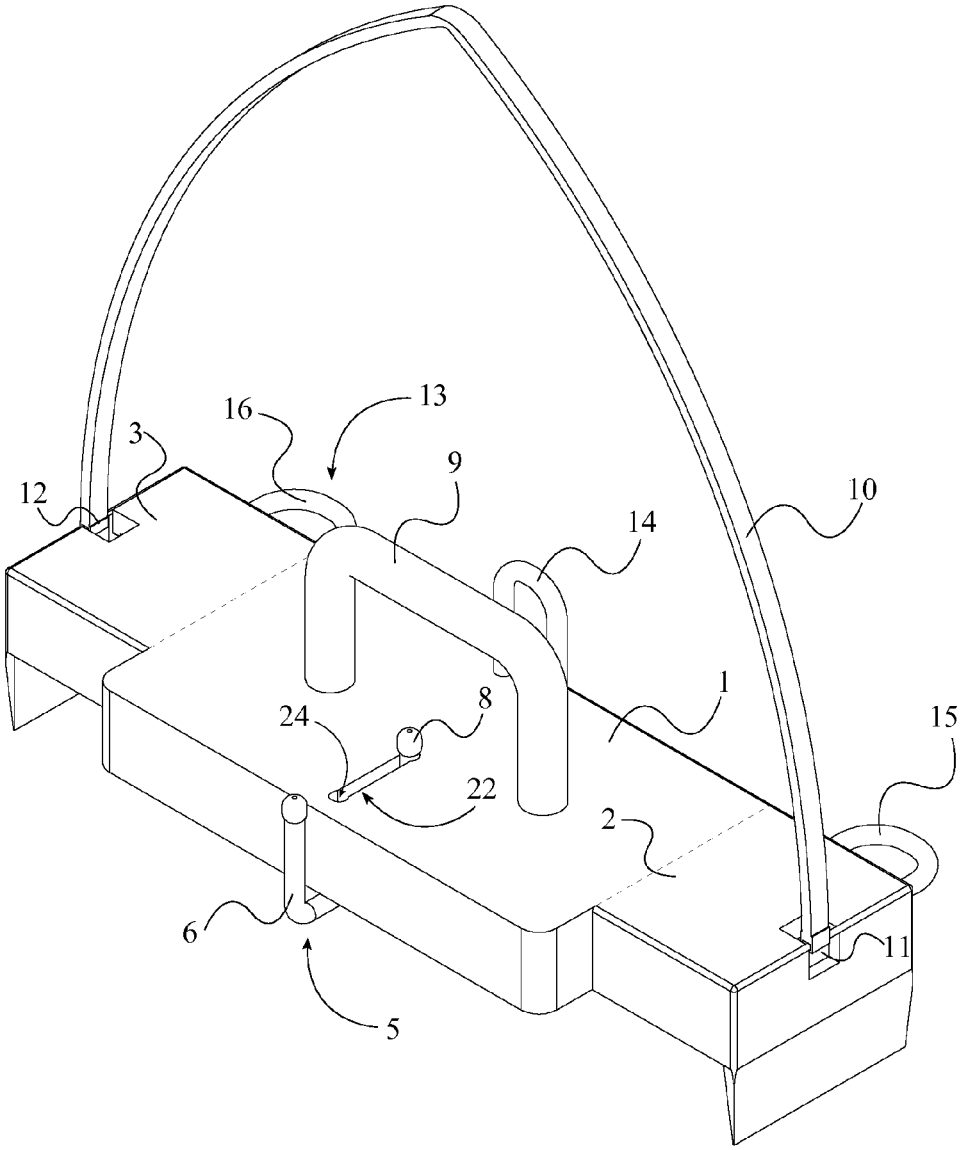
FIG. 1 is perspective view of the present invention, wherein the locking nub is at the locking end.

All illustrations of the drawings are for the purpose of describing selected versions of the present invention and are not intended to limit the scope of the present invention.

The present invention introduces an apparatus for holding reusable bags and dispensing the reusable bags accordingly. By utilizing the present invention, a user can carry a plurality of grocery bags to the store and pack them within a short time period.

The effective design of the present invention also makes the bag dispensing process more efficient.

As seen in FIGS. 1-4, the present invention comprises a structural base 1, a first arm-bracing wing 2, a second arm-bracing wing 3, an elastic restraint 4, an at least one securing band 13, and a bag storing hanger 5. The structural base 1 is the main body of the present invention and is positioned in between the first arm-bracing wing 2 and the second arm-bracing wing 3. In the preferred embodiment of the present invention, the structural base 1 is rectangular in shape. However, in another embodiment of the present invention, the structural base 1 can have a different shape. The first arm-bracing wing 2 and the second arm-bracing wing 3 are utilized to hold the present invention steady against a grocery bag holder since stability is essential when loading grocery items into the grocery bag. In order to do so, the first arm-bracing wing 2 is adjacently connected to the structural base 1. Similarly, the second arm-bracing wing 3 is adjacently connected to the structural base 1, opposite to the first arm-bracing wing 2. When the present invention is utilized on the grocery bag holder, the first arm-bracing wing 2 rests on one arm of the grocery bag holder. Similarly, the second arm-bracing wing 3 rests on the other arm of the grocery bag holder opposite the first arm-bracing wing 2. In another instance, when the present invention is utilized on a pair of bag dispensing arms, the first arm-bracing wing 2 rests on a first arm of the pair of bag dispensing arms. Likewise, the second arm-bracing wing 3 rests on a second arm of the pair of bag dispensing arms. The bag storing hanger 5 is utilized to store a plurality of reusable bags 17. The elastic restraint 4 fastens the plurality of reusable bags 17 stored on the bag storing hanger 5 together. The elastic restraint 4 is especially beneficial when transporting the plurality of the reusable bags 17. In addition to the first arm-bracing wing 2 and the second arm bracing wing 3, the at least one securing band 13 also ensures that the present invention is secured against the grocery bag holder or the pair of bag dispensing arms.

Figure 2:
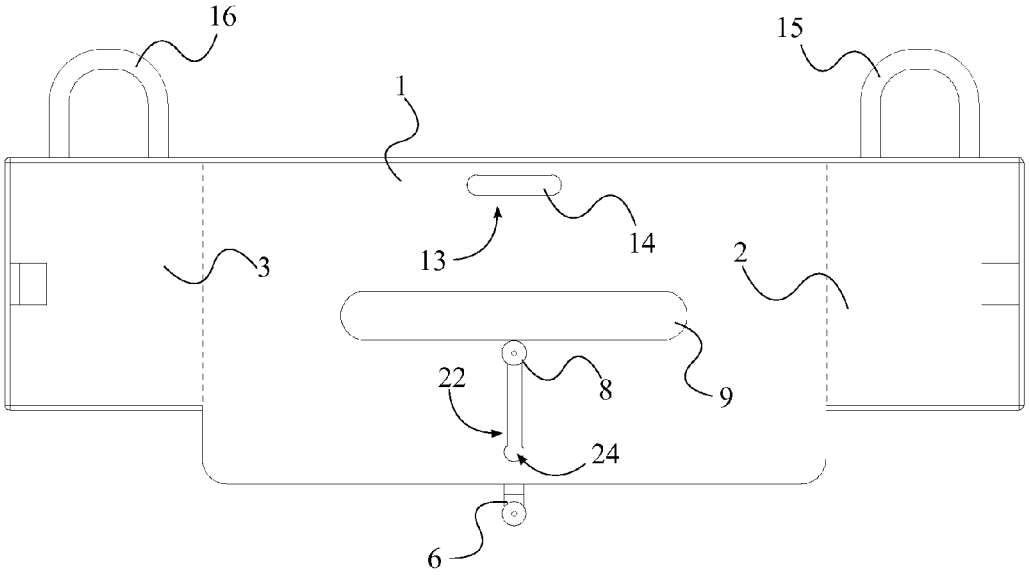
FIG. 2 is a top view of the present invention, wherein the locking nub is at the locking end.
Figure 3:
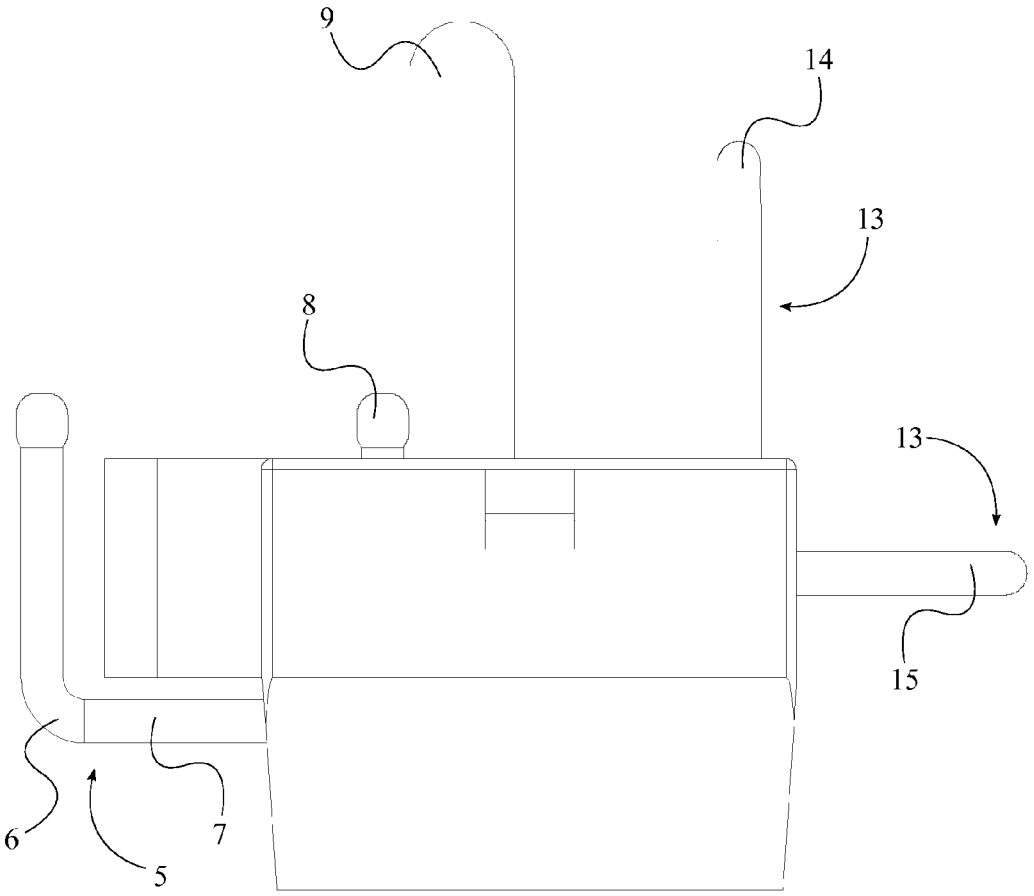
FIG. 3 is a right side view of the present invention, wherein the locking nub is at the locking end.
Figure 7:
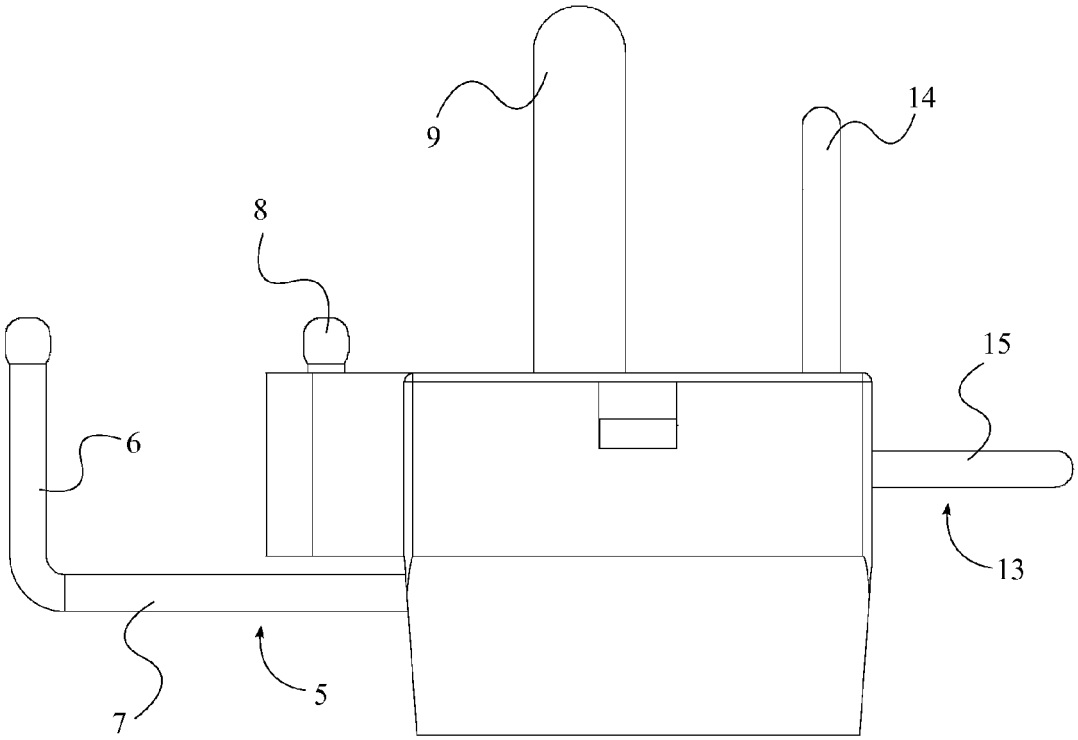
FIG. 7 is a right side view of the present invention, wherein the locking nub is in the unlocking end.
Figure 8:
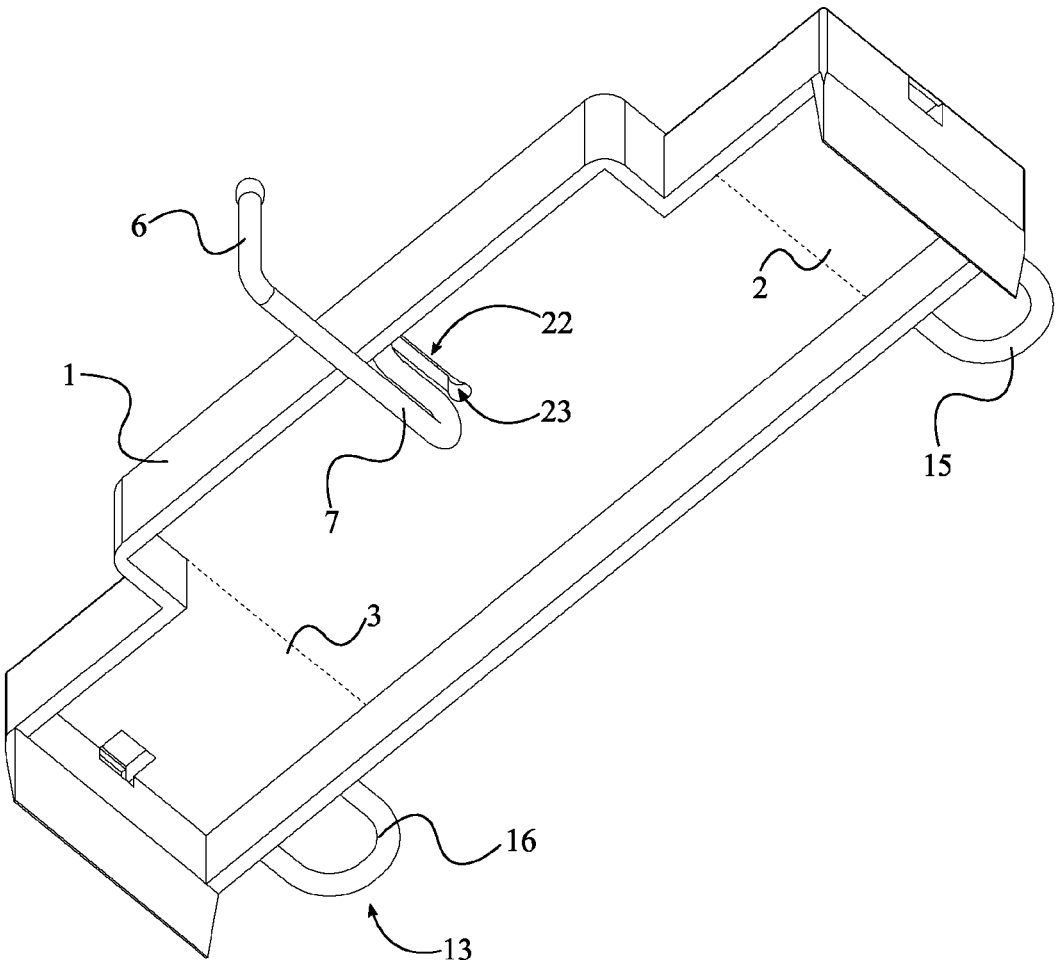
FIG. 8 is a bottom perspective view of the present invention, wherein the locking nub is at the unlocking end.
Figure 12:
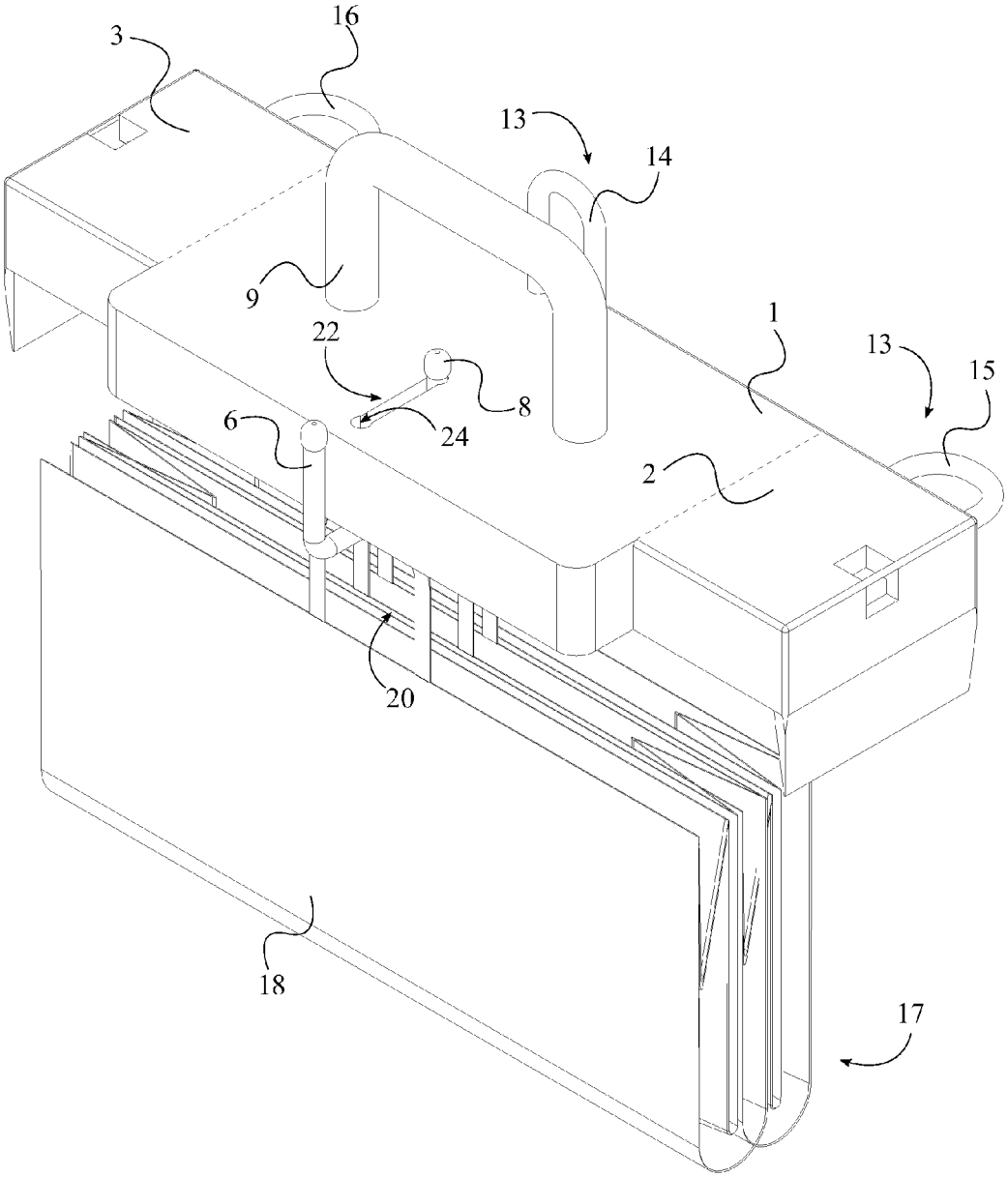
FIG. 12 is a perspective view of the present invention, wherein the reusable bag is in a locked configuration.
Figure 13:
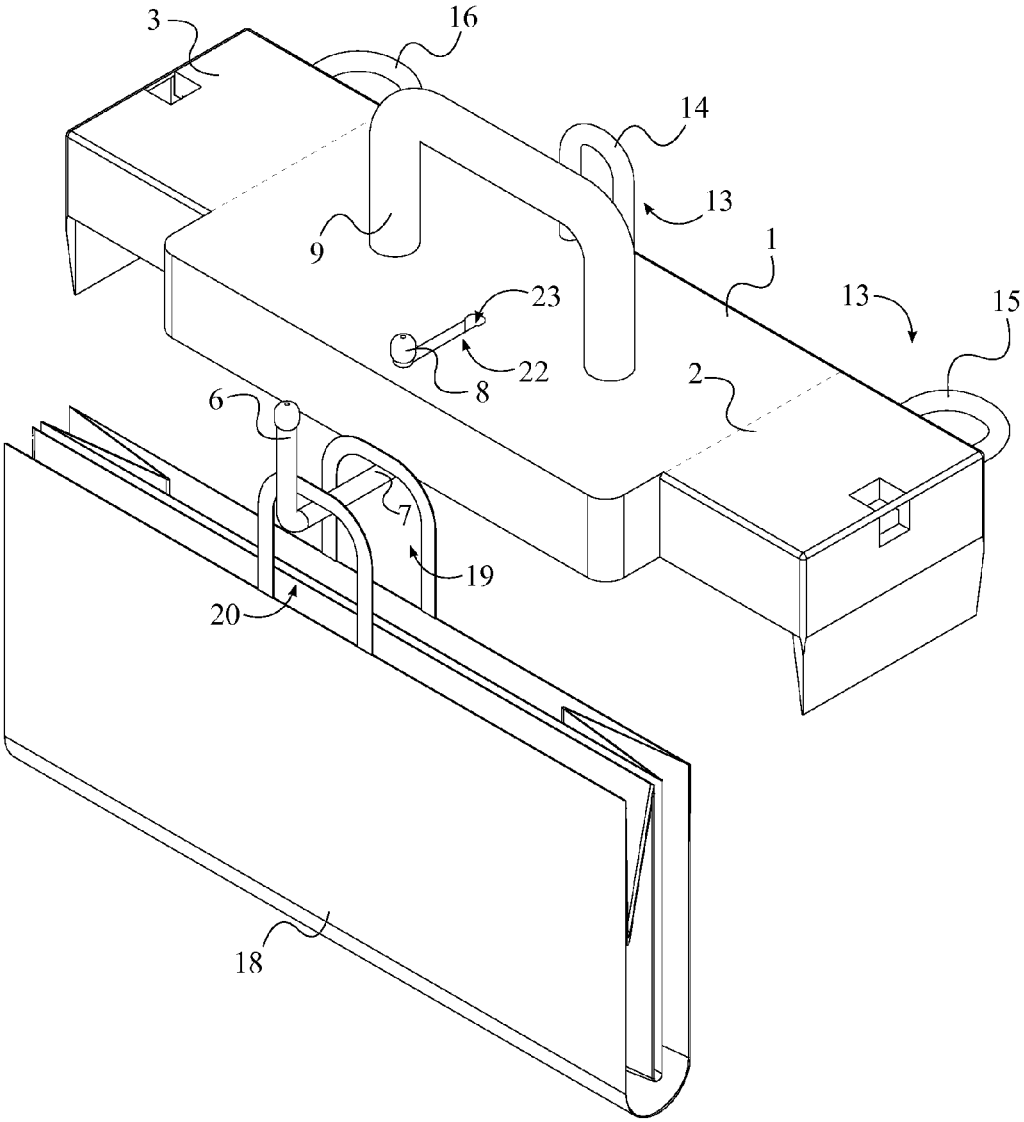
FIG. 13 is another perspective view of the present invention, wherein the reusable bag is in a locked configuration.
Figure 14:
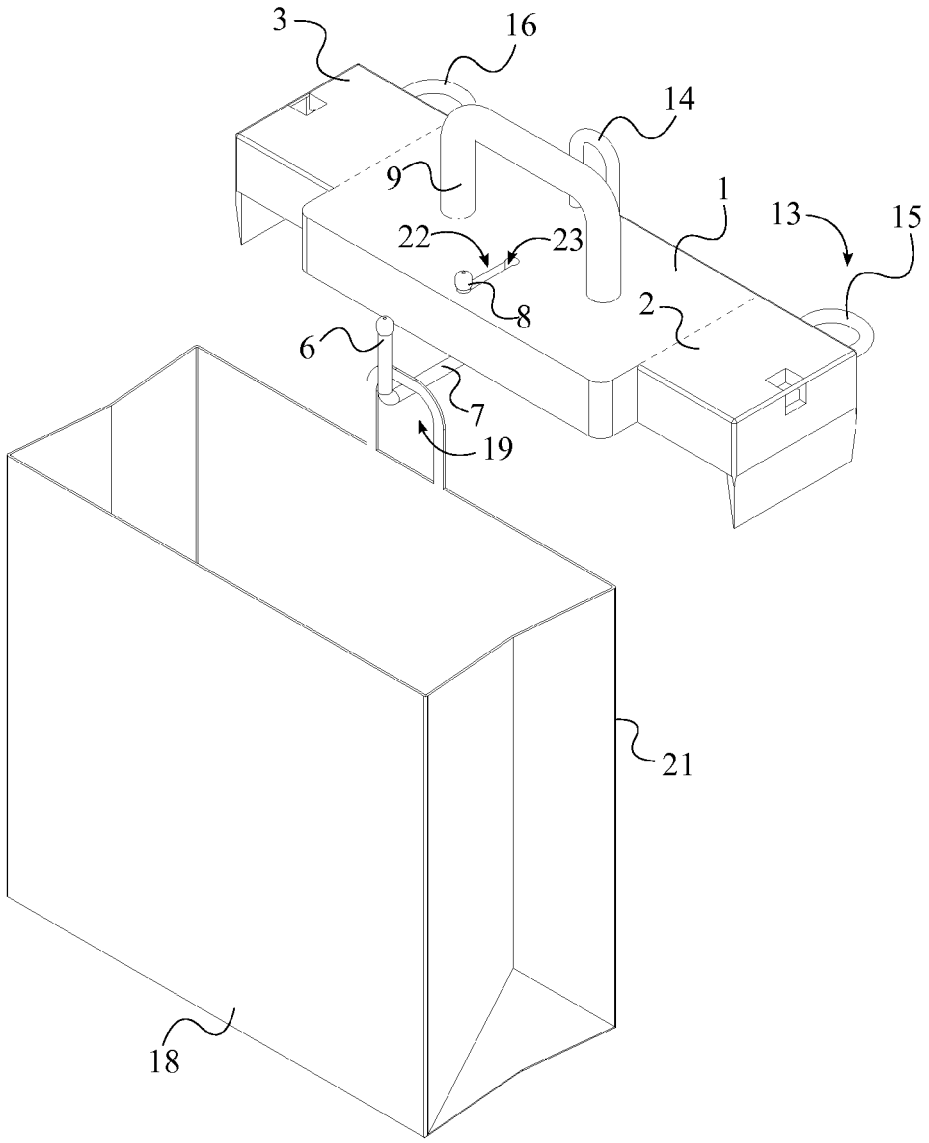
FIG. 14 is a perspective view of the present invention, wherein the reusable bag is in a unfolded configuration.
Figure 15:
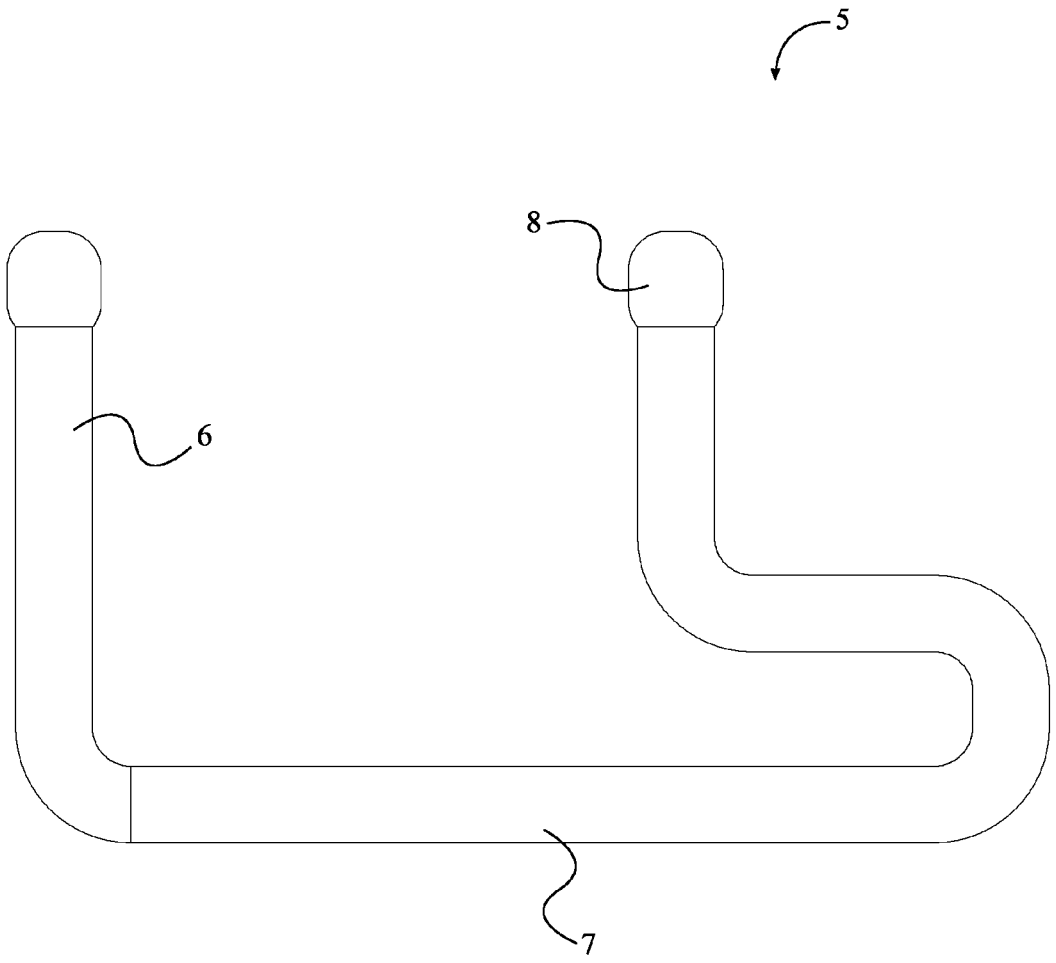
FIG. 15 is a right side view of the bag storing hanger.

As illustrated in FIG. 2 and FIG. 15, the bag storing hanger 5 comprises a hook portion 6 and a racking portion 7, and is positioned in between the first arm-bracing wing 2 and the second arm-bracing wing 3. The central positioning of the bag storing hanger 5 is beneficial when packing the plurality of reusable bags 17 with grocery items. As illustrated in FIGS. 12-14, the hook portion 6 is utilized to hook each of the plurality of reusable bags 17 onto the bag storing hanger 5, and the racking portion 7 is utilized to store each of the plurality of reusable bags 17. In order to allow the user to conveniently hook each of the plurality of reusable bags 17, the hook portion 6 laterally extends from the structural base 1 as illustrated in FIG. 3 and FIG. 7. Moreover, the racking portion 7 is removably attached to the structural base 1 such that each of the plurality of reusable bags 17 can be inserted onto the hook portion 6 efficiently. When the plurality of reusable bags 17 is stored on the racking portion 7, each of the plurality of reusable bags 17 is positioned underneath the structural base 1 as seen in FIG. 12.

Figure 4:
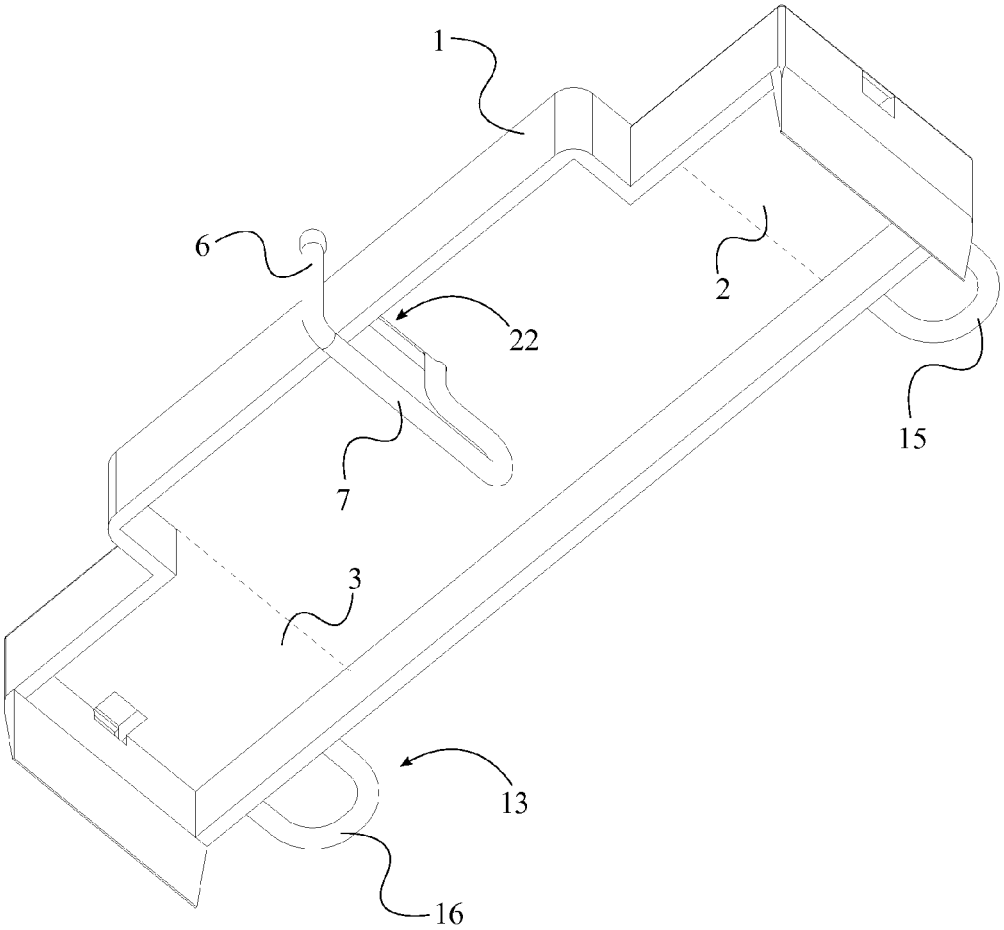
FIG. 4 is a bottom perspective view of the present invention, wherein the locking nub is at the locking end.
Figure 5:
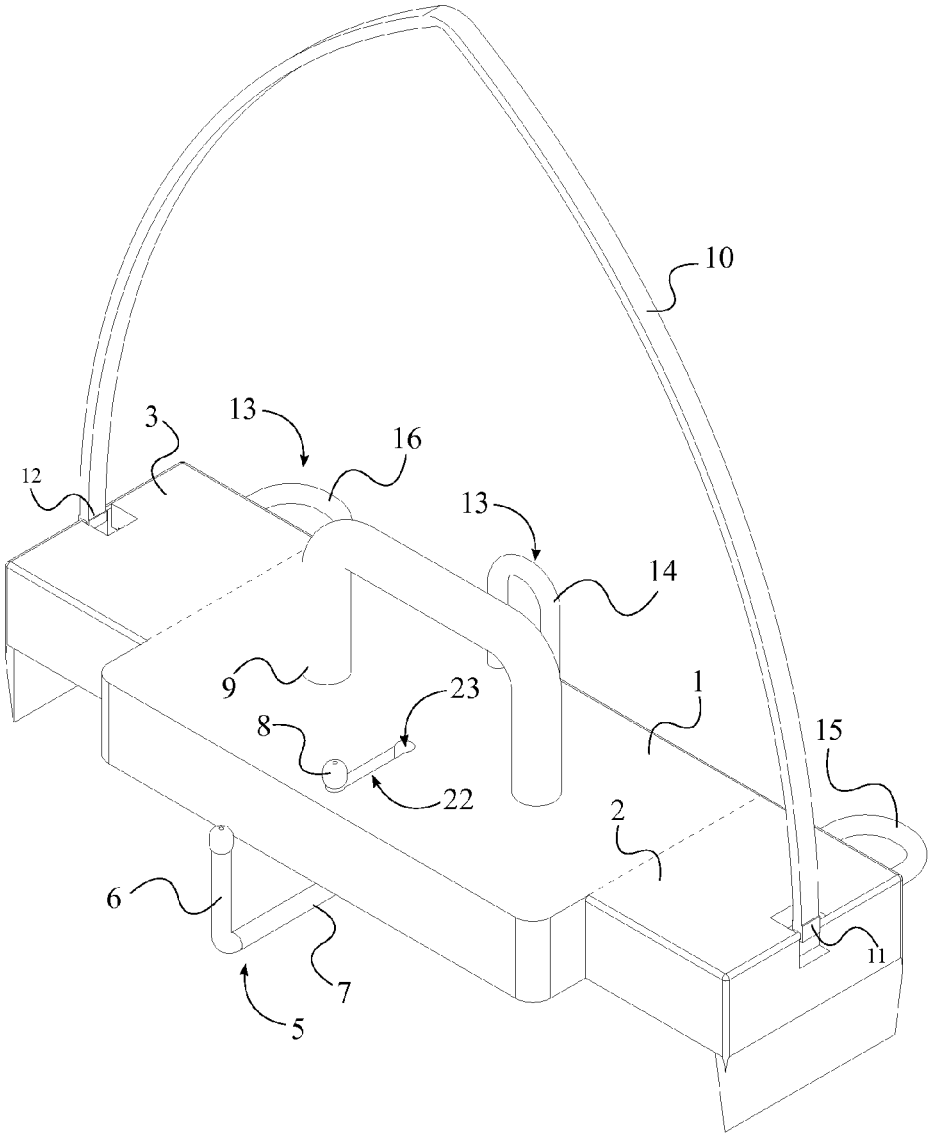
FIG. 5 is a perspective view of the present invention, wherein the locking nub is at the unlocking end.

In the preferred embodiment of the present invention, the plurality of reusable bags 17 is secured in place with a locking mechanism. More specifically, the plurality of reusable bags 17 is locked in place by utilizing a locking slot 22. As seen in FIG. 4, the locking slot 22 traverses through the structural base 1 in between the first arm-bracing wing 2 and the second arm-bracing wing 3. The locking slot 22 is centrally positioned on the structural base 1 and is parallel to the bag storing hanger 5. As illustrated in FIG. 15, the bag storing hanger 5 further comprises a locking nub 8 which is engaged in the locking slot 22. As a result, the user can control the bag storing hanger 5 by controlling the locking nub 8. In the preferred embodiment of the present invention, the locking slot 22 contains a locking end 23 and an unlocking end 24. As seen in FIG. 1 and FIG. 3, when the locking nub 8 is securely positioned at the locking end 23, the hook portion 6 is positioned adjacent the structural base 1 such that the plurality of reusable bags 17 is secured in place on the racking portion 7. When the locking nub 8 is securely positioned at the unlocking end 24 of the locking slot 22, the hook portion 6 is distally positioned from the structural base 1 allowing the user to dispense each of the plurality of reusable bags 17 as desired. FIG. 5 and FIG. 7 illustrate the position of the hook portion 6 when the locking nub 8 is securely positioned at the unlocking end 24. However, in another embodiment of the present invention a different locking mechanism can be utilized.

Figure 9:
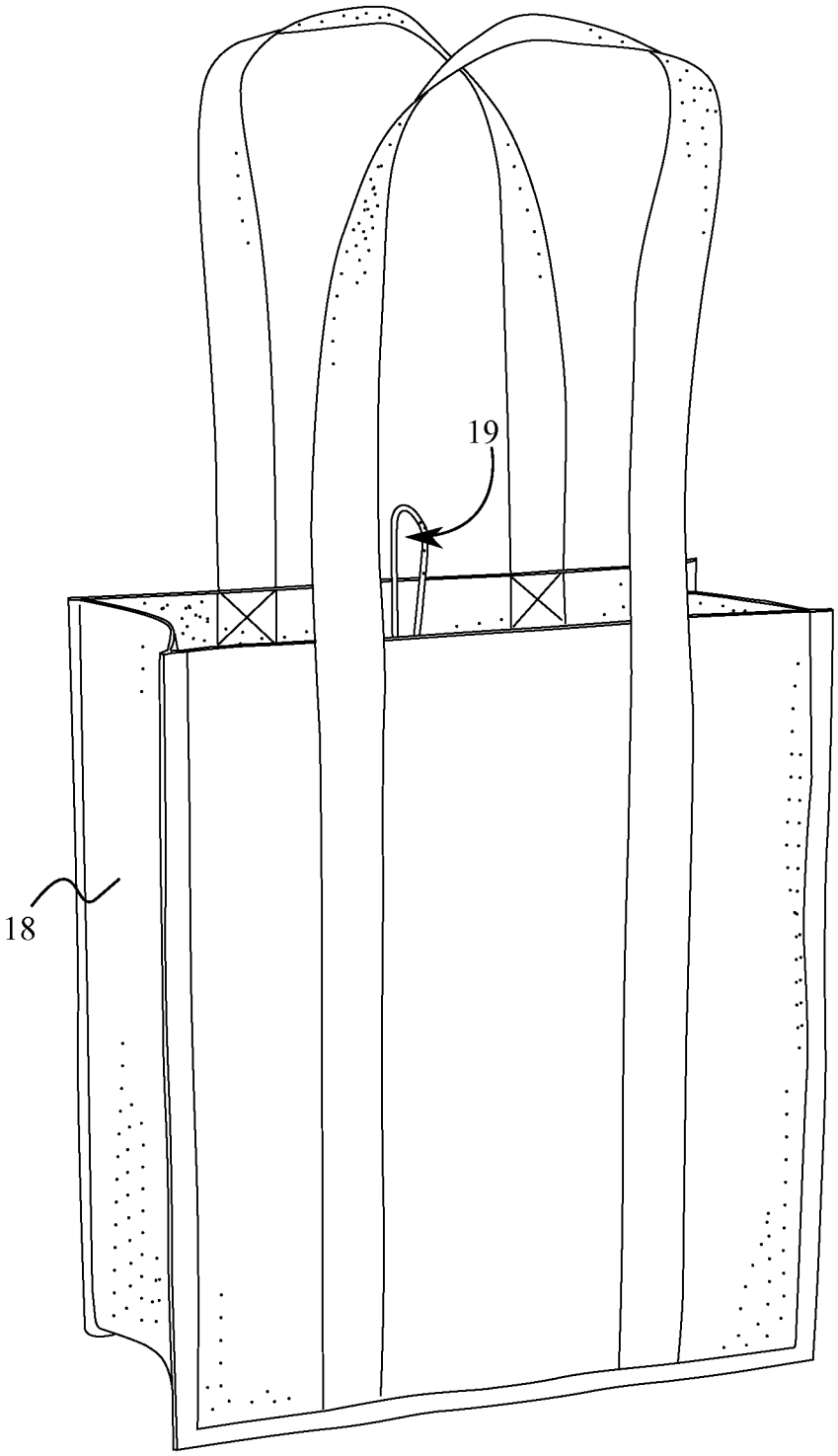
FIG. 9 is a perspective view of the reusable bag.
Figure 10:
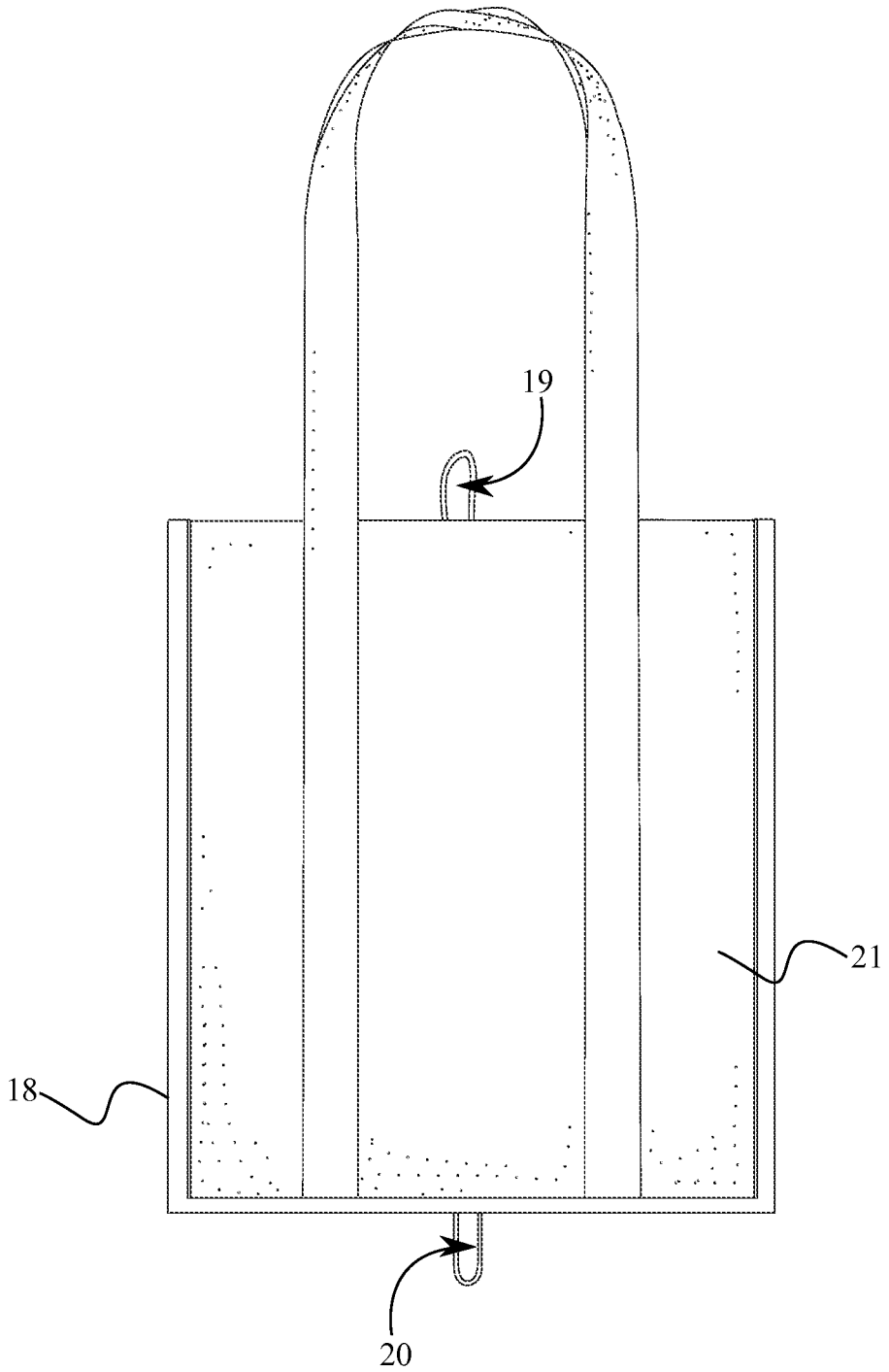
FIG. 10 is a side view of the reusable bag.
Figure 11:
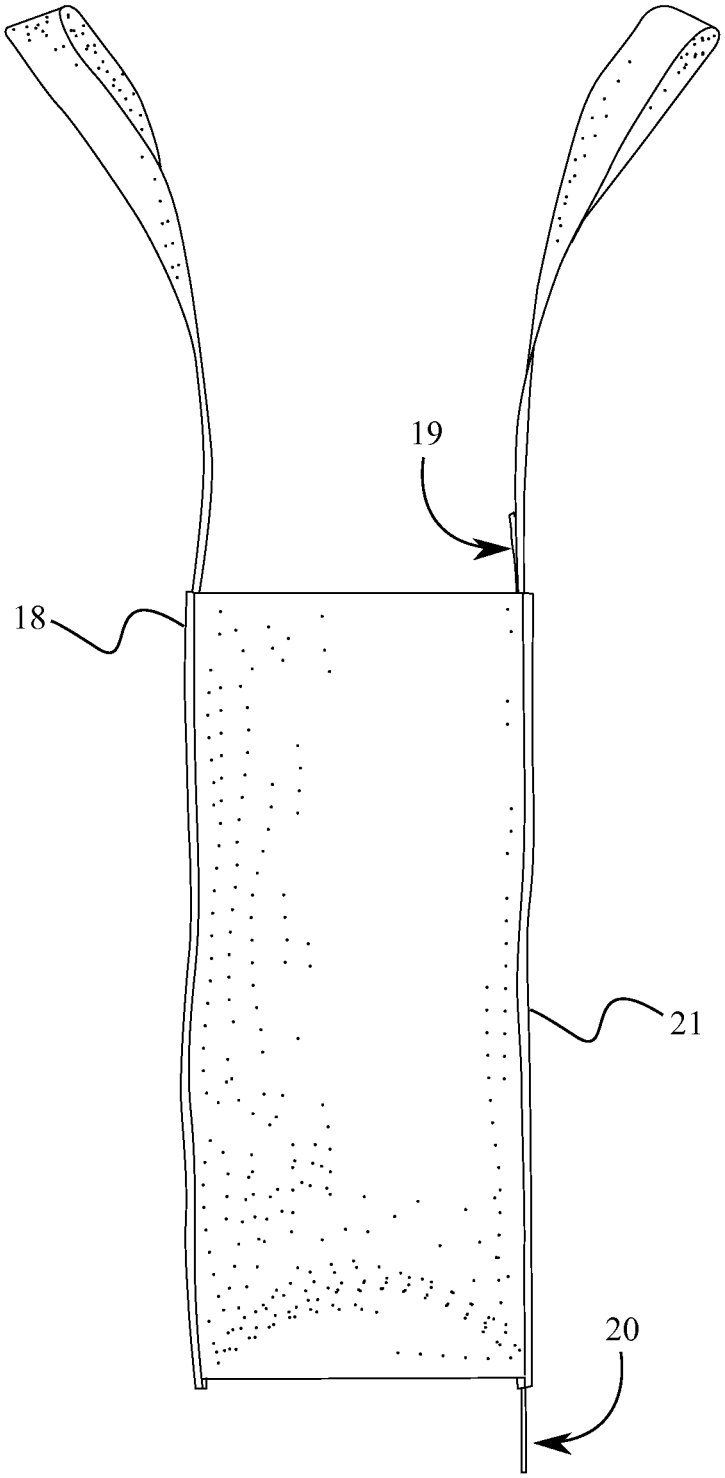
FIG. 11 is another side view of the reusable bag.

The effective design of the plurality of reusable bags 17 utilized in the preferred embodiment of the present invention allows the plurality of reusable bags 17 to be easily attached onto the structural base 1. As seen in FIG. 9 and FIG. 10, each of the plurality of reusable bags 17 comprises a tote bag 18, a first loop 19, and a second loop 20. The tote bag 18 allows the user to store a number of grocery items similar to other reusable bags in the market. The size of the tote bag 18 can differ in various embodiments of the present invention. The first loop 19 is connected adjacent to the tote bag 18 and adjacent to an opening of the tote bag 18. Similar to the first loop 19, the second loop 20 is also connected adjacent to the tote bag 18. However, the second loop 20 is connected adjacent to a base of the tote bag 18. Moreover, the first loop 19 and the second loop 20 are aligned opposite to each other across a lateral face 21 of the tote bag 18. The positioning of the first loop 19 and the second loop 20 allows the user to store the plurality of reusable bags 17 in a folded configuration as shown in FIG. 12 and FIG. 13. The folded configuration is especially beneficial when transporting the present invention since the folded configuration minimizes the space required to store the present invention. When each of the plurality of reusable bags 17 is in the folded configuration and hooked onto the hook portion 6, the first loop 19 is concentric with the second loop 20. Furthermore, the racking portion 7 traverses through the first loop 19 and the second loop 20 when the plurality of reusable bags 17 is in the folded configuration and hooked through the hook portion 6.

Figure 19:
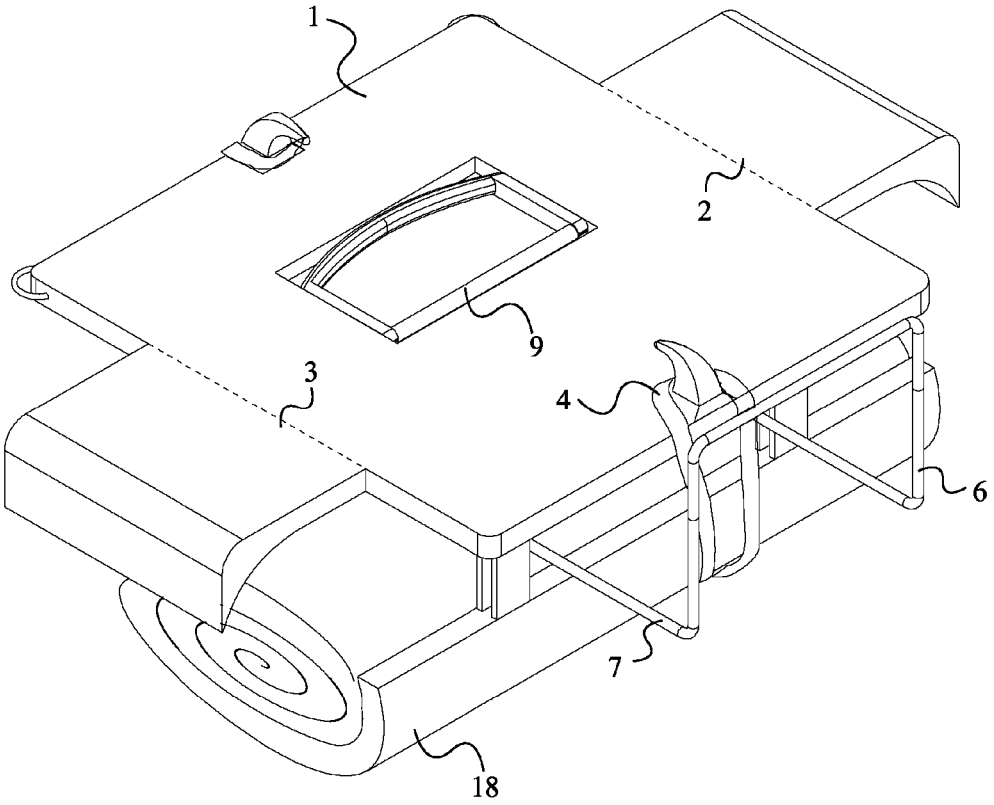
FIG. 19 is a perspective view of the present invention, wherein the reusable bag is secured with the elastic restraint.

As mentioned before, the elastic restraint 4 is utilized to secure the plurality of reusable bags 17 together for convenience purposes. In the preferred embodiment of the present invention, a first end of the elastic restraint 4 is attached to the hook portion 6. Similarly, an opposite end of the elastic restraint 4 is attached to the locking nub 8. The elastic restraint 4 is positioned around the plurality of reusable bags 17 in between the first arm-bracing wing 2 and the second arm-bracing wing 3. As a result, the plurality of reusable bags 17 is held together in the folded configuration against the bag storing hanger 5. The central positioning of the elastic restraint 4 eliminates the need to have multiple restraints along the structural base 1 to secure the plurality of reusable bags 17. Even though the elastic restraint 4 is attached to the bag storing hanger 5 in the preferred embodiment of the present invention, in another embodiment of the present invention the elastic restraint 4 can be looped around a plurality of hooks positioned on the structural base 1 as illustrated in FIG. 19.

Figure 16:
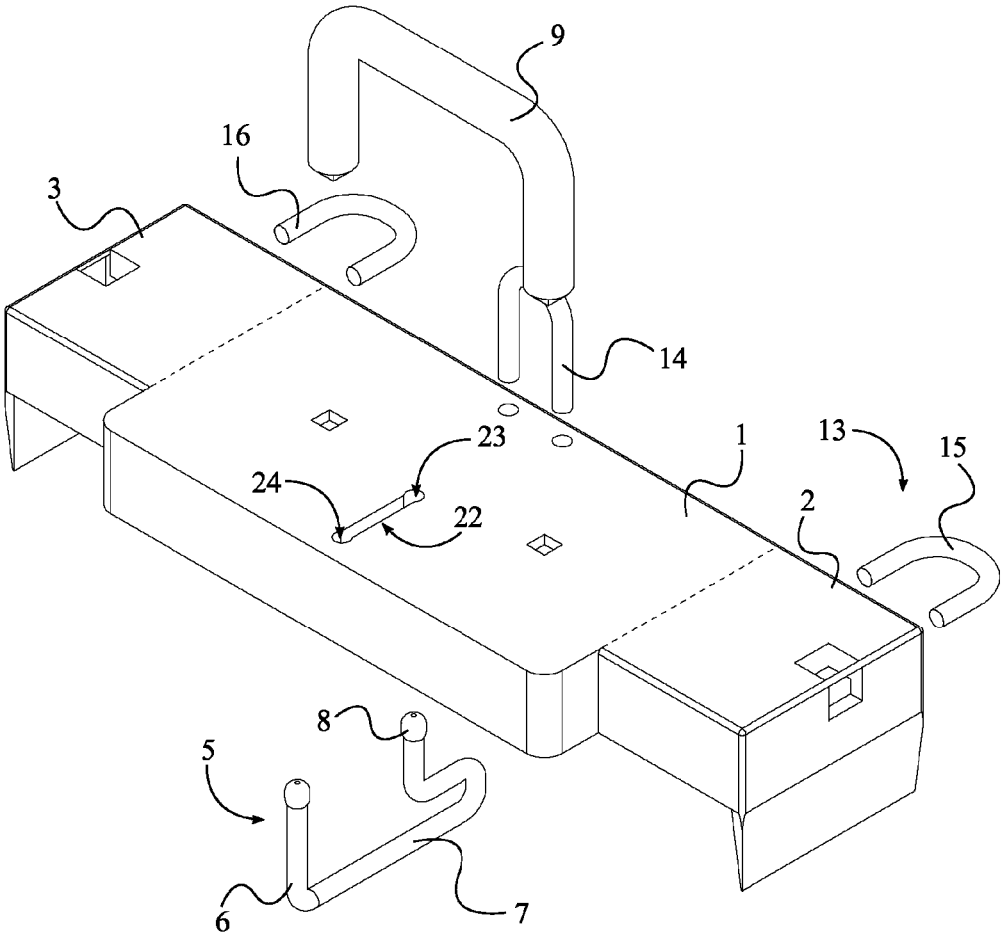
FIG. 16 is a perspective exploded view of the present invention.
Figure 17:
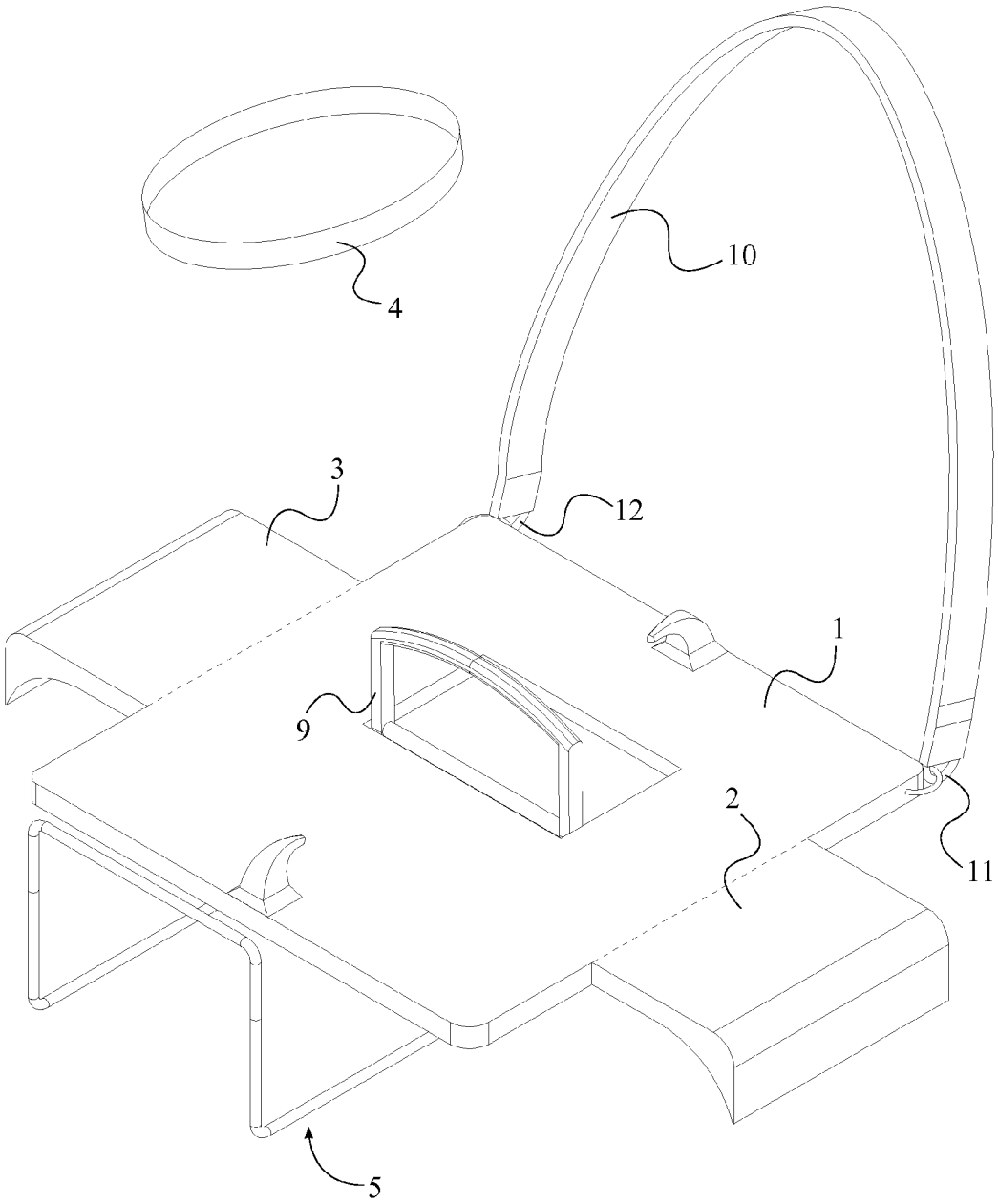
FIG. 17 is a perspective view of another embodiment of the present invention.
Figure 18:
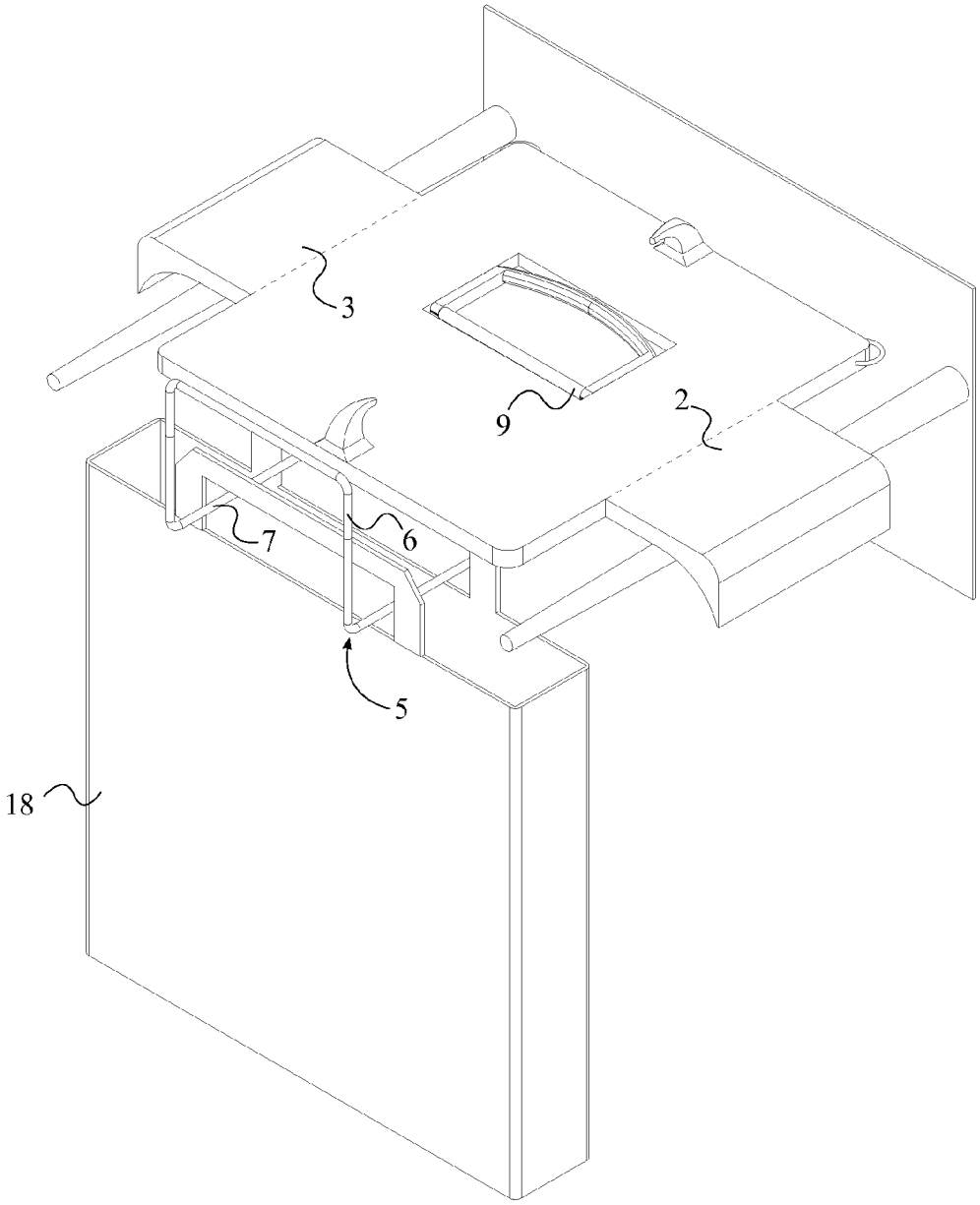
FIG. 18 is a perspective view of the present invention, wherein the reusable bag is hooked onto the bag storing hanger.

In order to provide ease in transportation, the present invention comprises a handle 9. As seen in FIG. 16 the handle 9 is removably attached onto the structural base 1 such that the entire weight can be conveniently controlled through the handle 9. In another embodiment of the present invention, the handle 9 can also be hingedly connected to the structural base 1 as illustrated in FIGS. 17-19. The hinged connection allows the user to collapse the handle 9 against the structural base 1 if preferred.

Figure 6:
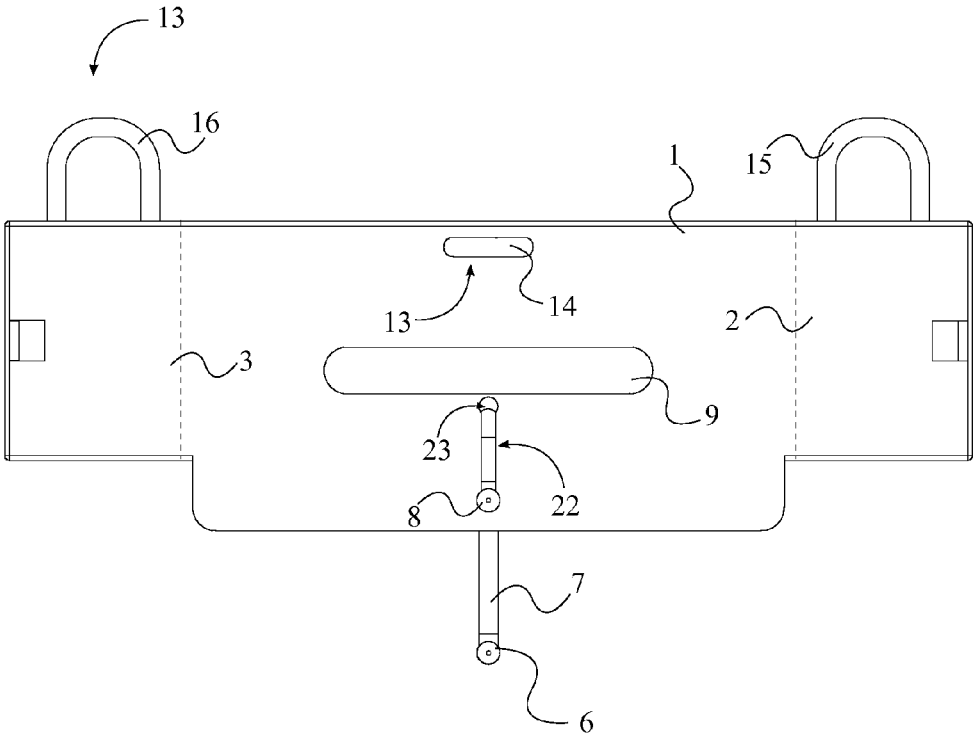
FIG. 6 is a top view of the present invention, wherein the locking nub is at the unlocking end.

In addition to the handle 9, the present invention comprises a carrying strap 10. The carrying strap 10 can be, but is not limited to, a shoulder strap. As seen in FIG. 1, FIG. 5 and FIG. 17, a first end 11 and a second end 12 of the carrying strap 10 is pivotally connected to the structural base 1 allowing the user to carry the present invention conveniently. To maximize handling of the present invention, the first end 11 and the second end 12 are offset from each other across the structural base 1. The present invention is secured to the grocery bag holder with at least one securing band 13. In the preferred embodiment of the present invention a bungee cord is utilized as the at least one securing band 13. As illustrated in FIG. 2 and FIG. 6, the at least one securing band 13 is connected to the structural base 1 opposite the hook portion 6 such that the user can utilize the bag storing hanger 5 with minimum interference. In the preferred embodiment of the present invention, the at least one securing band 13 comprises a central band 14. The central band 14 is positioned in between the first arm-bracing wing 2 and the second arm-bracing wing 3 and is attached to a central band receiving point on the grocery bag holder. When the central band 14 is attached to the grocery bag holder, the first arm-bracing wing 2 rests on a first arm of the grocery bag holder. Likewise, the second arm-bracing wing 3 rests on a second arm of the grocery bag holder opposite the first arm-bracing wing 2. The central band receiving point is typically metal and could take the shape of a metal loop, metal rod with ball point end, or other similar design.

As illustrated in FIG. 1 and FIG. 5, the at least on securing band 13 comprises a first band 15 and a second band 16. The first band 15 and the second band 16 are especially important when attaching the present invention to the pair of bag dispensing arms. Similar to the central band 14, the first band 15 and the second band 16 are also positioned opposite the hook portion 6 such that the user is able to utilize the hook portion 6 with minimum obstruction. When utilizing the first band 15 and the second band 16, the apparatus is resting on its back, then the user initially inserts a first arm of the grocery bag holder into the first band 15. Next, a second arm of the grocery bag holder is inserted into the second band 16. Since the first band 15 is positioned adjacent to the first arm-bracing wing 2, the first arm-bracing wing 2 rests on the first arm of the grocery bag holder. Likewise, since the second band 16 is positioned adjacent to the second-arm bracing wing, the second arm-bracing wing 3 rests on the second arm of the grocery bag holder. When attaching the present invention to the pair of bag dispensing arms, the first band 15 is inserted into the first arm of the pair of bag dispensing arms. Next, the second band 16 is inserted into the second arm of the pair of bag dispensing arms. Similar to the central band 14, the first band 15 and the second band 16 are also bungee cords in the preferred embodiment of the present invention. However, in another embodiment of the present invention, the first band 15 and the second band 16 can be made of a different elastic band.

In general, the following procedure is followed when storing the plurality of reusable bags 17. The user initially moves the locking nub 8 to the unlocking end 24 within the locking slot 22. As a result, the hook portion 6 is positioned away from the structural base 1 and the locking nub 8 is securely positioned within the unlocking end 24. When stacking a reusable bag of the plurality of reusable bags 17, the first loop 19 is initially inserted into the hook portion 6. Next, the reusable bag of the plurality of reusable bags 17 is folded such that the second loop 20 is concentric with the first loop 19. When each of the plurality of reusable bags 17 is in the folded configuration, the plurality of reusable bags 17 is stacked on the racking portion 7. By utilizing the elastic restraint 4, the user can secure the plurality of reusable bags 17 together when the plurality of reusable bags 17 is in the folded configuration. As a final step, the user moves the locking nub 8 to the locking end 23 of the locking slot 22, such that the locking nub 8 is securely positioned within the locking end 23. Resultantly, the plurality of reusable bags 17 is secured in the racking portion 7 as shown in FIG. 12.

When dispensing the plurality of reusable bags 17, the following procedure is followed. Initially the present invention is attached to the grocery bag holder with the at least one securing band 13. If the central band 14 is utilized, the central band 14 is attached to the grocery bag holder. On the other hand, if the first band 15 and the second band 16 are utilized, the first arm of the grocery bag holder is connected to the first band 15. Similarly, the second arm is connected to the second band 16 such that the present invention is secured against the grocery bag holder. In another instance, when the present invention is utilized on the pair of bag dispensing arms, the first band 15 and the second band 16 are utilized. In order to dispense each of the plurality of reusable bags 17, the user utilizes the locking nub 8. In the preferred embodiment of the present invention, the locking nub 8 is slid from the locking end 23 to the unlocking end 24 as illustrated in FIG. 13. Next, the elastic restraint 4 is removed from the bag storing hanger 5 such that each of the plurality of bags 17 can be removed. When the hook portion 6 is not pressed against the structural base 1, the user can proceed to remove each of the plurality of reusable bags 17 by initially removing the second loop 20, and then removing the first loop 19 from the hook portion 6. When the need occurs to transport the present invention, the user utilizes either the handle 9 or the carrying strap 10.

Although the invention has been explained in relation to its preferred embodiment, it is to be understood that many other possible modifications and variations can be made without departing from the spirit and scope of the invention as hereinafter claimed.

What is claimed is:

1. An apparatus for holding and dispensing reusable bags comprises:

a structural base;

a first arm-bracing wing;

a second arm-bracing wing;

an at least one securing band;

a bag storing hanger;

the bag storing hanger comprises a hook portion and a racking portion;

the first arm-bracing wing being adjacently connected to the structural base;

the second arm-bracing wing being adjacently connected to the structural base, opposite the first arm-bracing wing;

the bag storing hanger being positioned in between the first arm-bracing wing and the second arm-bracing wing;

the racking portion being removably attached to the structural base;

the hook portion laterally extending from the structural base;

the securing band being connected to the structural base, opposite the hook portion;

the at least one securing band comprises a first band and a second band;

the first band being positioned adjacent to the first arm-bracing wing; and the second band being positioned adjacent to the second arm-bracing wing.

2. The apparatus for holding and dispensing reusable bags as claim 1 comprises:

a handle; and the handle being removably attached onto the structural base.

3. The apparatus for holding and dispensing reusable bags as claim 1 comprises:

a handle; and the handle being hingedly connected onto the structural base.

4. The apparatus for holding and dispensing reusable bags as claim 1 comprises:

a carrying strap;

a first end of the carrying strap being pivotally connected to the first arm-bracing wing; and a second end of the carrying strap being pivotally connected to the second arm-bracing wing.

5. The apparatus for holding and dispensing reusable bags as claim 1 comprises:

the at least one securing band comprises a central band; and the central band being positioned in between the first arm-bracing wing and the second arm-bracing wing.

6. The apparatus for holding and dispensing reusable bags as claim 1 comprises:

a plurality of reusable bags;

each of the plurality of reusable bags comprises a tote bag, a first loop, and a second loop;

the first loop being connected adjacent to the tote bag, adjacent to an opening of the tote bag;

the second loop being connected adjacent to the tote bag, adjacent to a base of the tote bag; and the first loop and the second loop being aligned opposite to each other across a lateral face of the tote bag.

7. The apparatus for holding and dispensing reusable bags as claim 6 comprises:

an elastic restraint;

each of the plurality of reusable bags being in a folded configuration in order to position the first loop concentric to the second loop;

the racking portion traversing through the first loop and the second loop for each of the plurality of reusable bags; and the elastic restraint being positioned around the plurality of reusable bags, wherein elastic restraint secures the plurality of reusable bags.

8. The apparatus for holding and dispensing reusable bags as claim 1 comprises:

a locking slot;

the bag storing hanger further comprises a locking nub;

the locking slot traversing through the structural body in between the first arm-bracing wing and the second arm-bracing wing;

the locking slot being positioned parallel to the bag storing hanger; and the locking nub being engaged into the locking slot.

9. An apparatus for holding and dispensing reusable bags comprises:

a structural base;

a first arm-bracing wing;

a second arm-bracing wing;

an at least one securing band;

a bag storing hanger;

a carrying strap;

the bag storing hanger comprises a hook portion and a racking portion;

the first arm-bracing wing being adjacently connected to the structural base;

the second arm-bracing wing being adjacently connected to the structural base, opposite the first arm-bracing wing;

the bag storing hanger being positioned in between the first arm-bracing wing and the second arm-bracing wing;

the racking portion being removably attached to the structural base;

the hook portion laterally extending from the structural base;

the securing band being connected to the structural base, opposite the hook portion;

a first end of the carrying strap being pivotally connected to the first arm-bracing wing;

a second end of the carrying strap being pivotally connected to the first arm-bracing wing;

a locking slot;

the bag storing hanger further comprises a locking nub;

the locking slot traversing through a structural body in between the first arm-bracing wing and the second arm-bracing wing;

the locking slot being positioned parallel to the bag storing hanger; and the locking nub being engaged into the locking slot.

10. The apparatus for holding and dispensing reusable bags as claim 9 comprises:

a handle; and the handle being removably attached onto the structural base.

11. The apparatus for holding and dispensing reusable bags as claim 9 comprises:

a handle; and the handle being hingedly connected onto the structural base.

12. The apparatus for holding and dispensing reusable bags as claim 9 comprises:

the at least one securing band comprises a central band; and the central band being positioned in between the first arm-bracing wing and the second arm-bracing wing.

13. The apparatus for holding and dispensing reusable bags as claim 9 comprises:

the at least one securing band comprises a first band and a second band;

the first band being positioned adjacent to the first arm-bracing wing; and the second band being positioned adjacent to the second arm-bracing wing.

14. The apparatus for holding and dispensing reusable bags as claim 9 comprises:

a plurality of reusable bags;

each of the plurality of reusable bags comprises a tote bag, a first loop, and a second loop;

the first loop being connected adjacent to the tote bag, adjacent to an opening of the tote bag;

the second loop being connected adjacent to the tote bag, adjacent to a base of the tote bag; and the first loop and the second loop being aligned opposite to each other across a lateral face of the tote bag.

15. The apparatus for holding and dispensing reusable bags as claim 14 comprises:

an elastic restraint;

each of the plurality of reusable bags being in a folded configuration in order to position the first loop concentric to the second loop;

the racking portion traversing through the first loop and the second loop for each of the plurality of reusable bags; and the elastic restraint being positioned around the plurality of reusable bags, wherein elastic restraint secures the plurality of reusable bags.

* * * * *